US008287216B2

(12) United States Patent
Frett

(10) Patent No.: US 8,287,216 B2
(45) Date of Patent: Oct. 16, 2012

(54) METHOD FOR SECURING FREIGHT

(75) Inventor: John W Frett, Crete, IL (US)

(73) Assignee: Holland, L.P., Crete, IL (US)

( * ) Notice: Subject to any disclaimer, the term of this patent is extended or adjusted under 35 U.S.C. 154(b) by 715 days.

(21) Appl. No.: 12/319,443

(22) Filed: Jan. 6, 2009

(65) Prior Publication Data

US 2010/0172710 A1 Jul. 8, 2010

(51) Int. Cl.
*B60P 7/08* (2006.01)

(52) U.S. Cl. ..... 410/97; 410/100; 410/118

(58) Field of Classification Search ..... 410/10, 410/20, 23, 12, 50, 97, 100, 117, 118; 248/499; 105/355; 24/68 CD, 265 CD, 302
See application file for complete search history.

(56) References Cited

U.S. PATENT DOCUMENTS 2,023,972 A * 12/1935 Otis ..... 410/67
6,152,664 A 11/2000 Dew et al.
6,422,794 B1 7/2002 Zhan et al.
6,494,651 B1 12/2002 Zhan et al.
6,585,466 B2 7/2003 Zhan et al.
6,709,209 B2 3/2004 Zhan et al.
7,025,545 B1 * 4/2006 Robison ..... 410/20
7,214,014 B2 5/2007 Stanley
7,306,415 B2 12/2007 Halliar

OTHER PUBLICATIONS

Holland Company, Load Snugger System, (brochure) six pages, Crete, Illinois.

* cited by examiner

*Primary Examiner* — Stephen Gordon
(74) *Attorney, Agent, or Firm* — Meroni & Meroni, P.C.; Charles F. Meroni, Jr.; Christopher J. Scott

(57) ABSTRACT

A harness assembly for restraining freight having a relatively high center of gravity comprises first and second junction rings, and four tensile members. Two of the four members form a bifurcated harness when connected to the junction rings. The third and fourth tensile members each have a ring end and an anchor end. The ring ends are connected to the junction rings. The bifurcated harness, having a top-contacting member and a side-contacting member, respectively contacts a top end and a side portion of positioned freight. The anchor ends anchor the third and fourth tensile members to a support structure such as a railcar floor. The third and fourth tensile members thereby diagonally direct tension into the bifurcated harness relative to the support structure so as to force the top end of the freight toward the support structure and the side portion of the freight toward the anchor ends.

6 Claims, 17 Drawing Sheets

15
16
18
10
50
42
78
13
11

18
16
15
10
13
11
40

METHOD FOR SECURING FREIGHT

BACKGROUND OF THE INVENTION

1. Field of the Invention

The present invention generally relates to a system for securing freight, and more particularly to a method, apparatus, and system for securing railroad car borne freight having a relatively high center of gravity and/or unwieldy geometry.

2. Discussion of Prior Art

Freight borne by a railcar requires restraint or securement to stabilize it from shifting under the various loads imposed by draft, buff, and rocking of the railcar. For particular types of loads, such as large rolls of paper, coils of sheet material, palletized loads such as shrink-wrapped juices, or other similarly vulnerable cargo, tensioning mechanisms using straps and anchors are advantageous.

The most common load securement method for railcars handling cargo such as large heavy items is to load the items on a railcar floor and secure the items with a variety of chains or straps typically using hooks to anchor the securement member (the chain or strap) and toggle and adjustment devices for tensioning.

Often the hooks are attached to the chain or strap and are anchored to eyes, or bars in pockets, or other structural members on the railcar. Additionally, specialized anchors or hooks having generally T-shaped members on the strap or chain fit into corresponding recesses in a railcar floor or, in the case of a flatcar, occasionally into a recessed pocket whereby the head of the "T" bears against a specialized anchor piece in the pocket.

Other load securement practices in the rail industry in the prior art included numerous other mechanical load securement methods such as: blocks, chocks, and specialized mechanical locks often varying depending on a specialized load.

In response to the foregoing state of the art, Zahn et al. disclosed in U.S. Pat. No. 6,422,794 ('794 Patent ) a Cargo Snugger Strap and Hook Mechanism. The '794 Patent describes an anchor with an "L" shaped aperture receives a strap pin end, the lower leg of the "L" locking the pin in place, the strap bearing on a smoothly curved side wall, the pin being held in place when not under load by a clip member on the back of the anchor and being contained within a pocket in the wall of a railroad box freight car. A two part strap is shortened to fit the cargo load through the use of a combination of turns and bights around a three part clip having a generally oval ring with an upstanding half oval ring portion displacing the various parts of the strap threaded thereon to increase friction.

Zahn et al. further disclose in U.S. Pat. No. 6,494,651 ('651 Patent ); U.S. Pat. No. 6,585,466 ('466 Patent ); and U.S. Pat. No. 6,709,209 ('209 Patent ) various aspects of a Railcar Anchor and Load Snugger Arrangement. Each of the Patents may be said to describe a railcar load securement apparatus using an array of load securement anchors having bases adapted for strength and efficiency in mounting in a rail car, a plurality of vertical support members extending upwardly from a mounting base or bracket with a flush mounted anchor plate joining them, so that a plurality of tensioning members or straps can be readily mounted to retain cargo, but the anchor is flush to be unobstructive when unused. Flexibility in load adaptation is provided for in that a number of different load capture arrangements can be utilized.

Other pertinent prior may be found in U.S. Pat. No. 6,152,664, which issued to Dew et al. and describes a Cargo Restraining Apparatus comprising a cargo net, a plurality of buckles, and a plurality of anchor straps. The cargo net is formed of a plurality of intersecting woven webs and is preferably rectangular with two nonintersecting, free ends of webs at each corner. Each of the buckles include a C-bar to which two nonintersecting, free ends of the cargo net are attached. n anchor strap having an anchor end and a free end is fed through the buckle and used to apply tension to the two nonintersecting, free ends when the anchor end is connected to an anchor and the free end is pulled in a direction generally toward the anchor. Each buckle also includes a release tab for releasing tension applied to the two nonintersecting, free ends. Each buckle is preferable fabricated from a single piece of molded plastic with no moving parts. The apparatus is particularly well suited for use in securing cargo in the bed of a pick-up truck.

U.S. Pat. No. 7,214,014 ('014 Patent ), which issued to Stanley, discloses a Cargo Tie Down System. The '014 Patent describes a cargo restraint system comprising, a tie-down assembly of restraining tie-down arms having interconnected common proximal extremities and a plurality of distal extremities, the tie-down assembly arranged to form an angle between each arm, the vertex of the angle being congruent with the common proximal extremities, with a first fastener secured to the arms at the vertex of the angle and a second fastener secured to each of the distal extremities of the arms. Preferably, each of the arms carries a third fastener or connecting eye intermediate the first and second fasteners.

U.S. Pat. No. 7,306,415 ('415 Patent ), which issued to Halliar, discloses a Clamping System and Method for Securing Freight. The '415 Patent essentially describes a method and system for securing freight during transport whereby the method and system secure the freight by using rotatable clamping mechanisms configure to apply axial pressure to the freight so as to prevent movement or shifting in transit. The rotatable clamping mechanisms are rotatable between a fully-opened position, a closed position such that the freight is secured, and a stowed position.

It will be seen from a further review of the above-referenced patents and other prior art generally known to exist that the prior art does not teach a harness assembly for restraining freight having a relatively high center of gravity comprising first and second junction rings, and four tensile sections whereby first two of four sections diagonally direct tension into the second two of four sections via the junction rings for forcing a top end of freight toward a floor-type support structure and a side portion of freight toward anchor ends of the harness. Accordingly, the prior art perceives a need for such an apparatus as described in more detail hereinafter.

SUMMARY OF THE INVENTION

The present invention is preferably designed to operate and/or function in combination with the railcar anchors and/or load snugger arrangement generally described in the '651, '466, '209, and '794 Patents. In this regard, it is contemplated that the respective specifications thereof may be readily referenced and incorporated herein as supportive of certain concepts hereinafter described.

The present invention essentially provides a harness assembly or securement system preferably usable in combination with the railcar anchors and/or load snugger arrangement generally described in the '651, '466, '209, and '794 Patents. The harness assembly or securement system according to the present invention was developed in an effort to address unwieldy freight having a tendency to become dislodged or displaced from a secured position under state of the art securement systems. Freight that is top heavy or that has a relatively high center of gravity, for example, has a tendency to tip during transit, thereby becoming damaged or requiring added effort and cost to reposition.

To structurally address the foregoing concerns, the present invention provides a securement system incorporating a harness assembly or apparatus, preferably attachable to anchors substantially as described in the Zahn et al. patents referenced above, and usable in combination with the snugger system described in said patents as a means to provide added securement to freight, particularly railcar borne freight.

The harness assembly may be said to essentially comprise first and second junction rings, a bifurcated harness, and opposed third-type tensile members. The junction rings provide opposed junction sites for tensile member termini. The bifurcated harness comprises first and second tensile members, each of which have opposed member termini connected to the junction rings. The third-type tensile members, the third-type tensile members each have a ring end and an anchor end. The ring ends are connected to the junction rings, and the anchor ends extend away from the bifurcated harness.

The bifurcated harness, having a top-contacting member and a side-contacting member, contacts a top end and a side portion of positioned freight. The anchor ends of the third-type tensile members together anchor the third-type tensile members to a support structure such as a railcar floor. The third-type tensile members thereby diagonally direct tension to the bifurcated harness relative to the support structure so as to force the top end of the freight toward the support structure and the side portion of the freight toward the anchor ends of the harness assembly.

BRIEF DESCRIPTION OF THE DRAWINGS

FIG. 1(*b*) is a side view depiction of the first railcar otherwise depicted in FIG. 1(*a*) further showing the freight arrangement as anchored to the floor of the railcar via the securement system of the invention.

FIG. 2(*b*) is a side view depiction of the second railcar otherwise depicted in FIG. 2(*a*) further showing the freight arrangement as anchored to the floor of the railcar via the securement system of the invention.

FIG. 9(*b*) is a sectional edge view of a portion of the D-ring buckle structure and second tensile member joined thereto as otherwise depicted in FIG. 9(*a*).

FIG. 16(*b*) is an enlarged fragmentary side view depiction of the structures otherwise depicted in FIG. 16(*a*).

FIG. 17(*b*) is an enlarged fragmentary side view depiction of the structures otherwise depicted in FIG. 17(*a*).

FIG. 18(*b*) is an enlarged fragmentary side view depiction of the structures otherwise depicted in FIG. 18(*a*).

FIG. 19(*b*) is an enlarged fragmentary side view depiction of the structures otherwise depicted in FIG. 19(*a*).

FIG. 20(*b*) is an enlarged fragmentary side view depiction of the structures otherwise depicted in FIG. 20(*a*).

FIG. 21(*b*) is an enlarged fragmentary side view depiction of the structures otherwise depicted in FIG. 21(*a*).

DETAILED DESCRIPTION OF THE PREFERRED EMBODIMENT AND METHOD

Figures 1A, 1B:
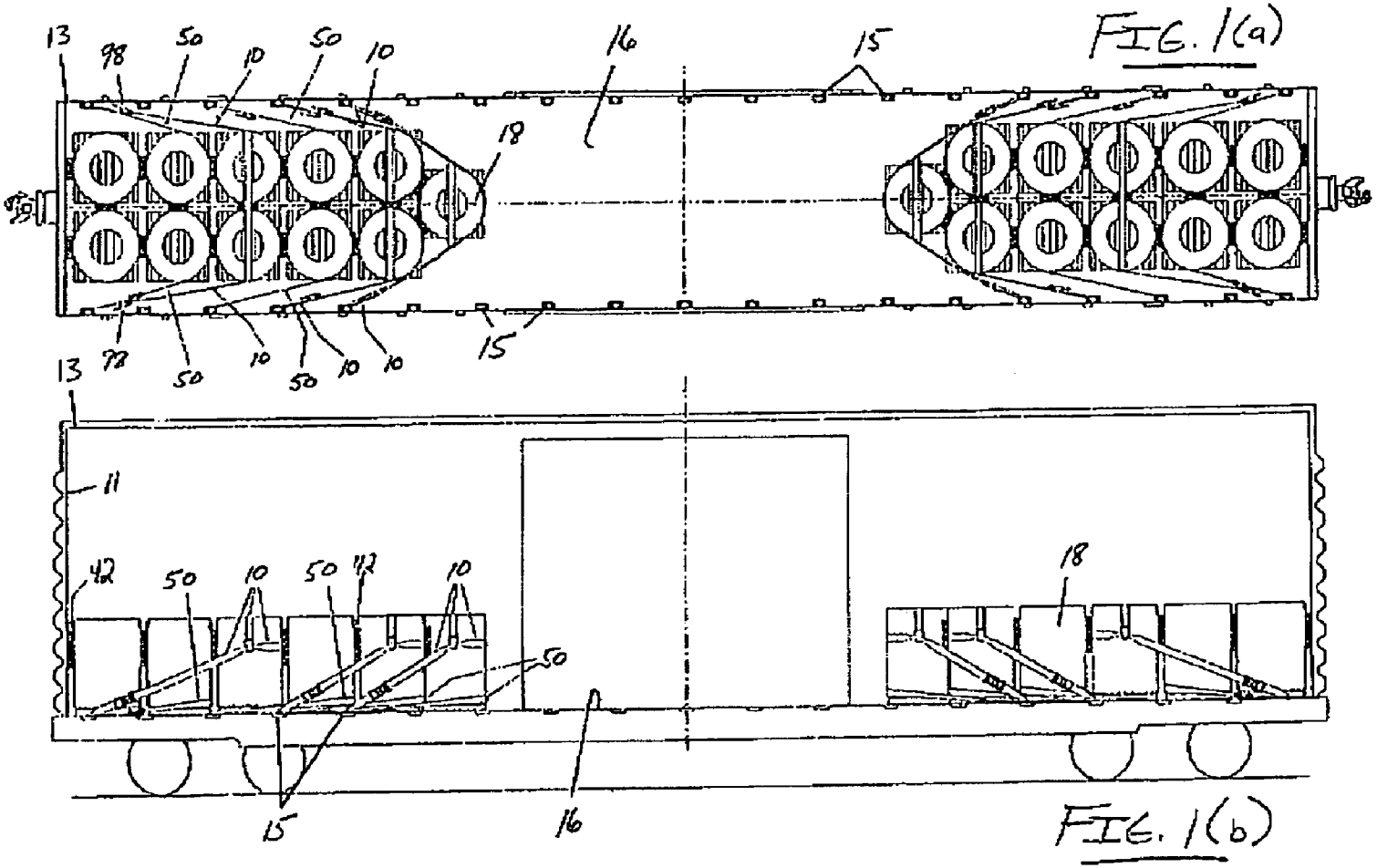
FIG. 1(*a*) is a top plan view of a first railcar showing a first freight arrangement as anchored to the floor of the railcar via the securement system of the invention.
Figures 2A, 2B:
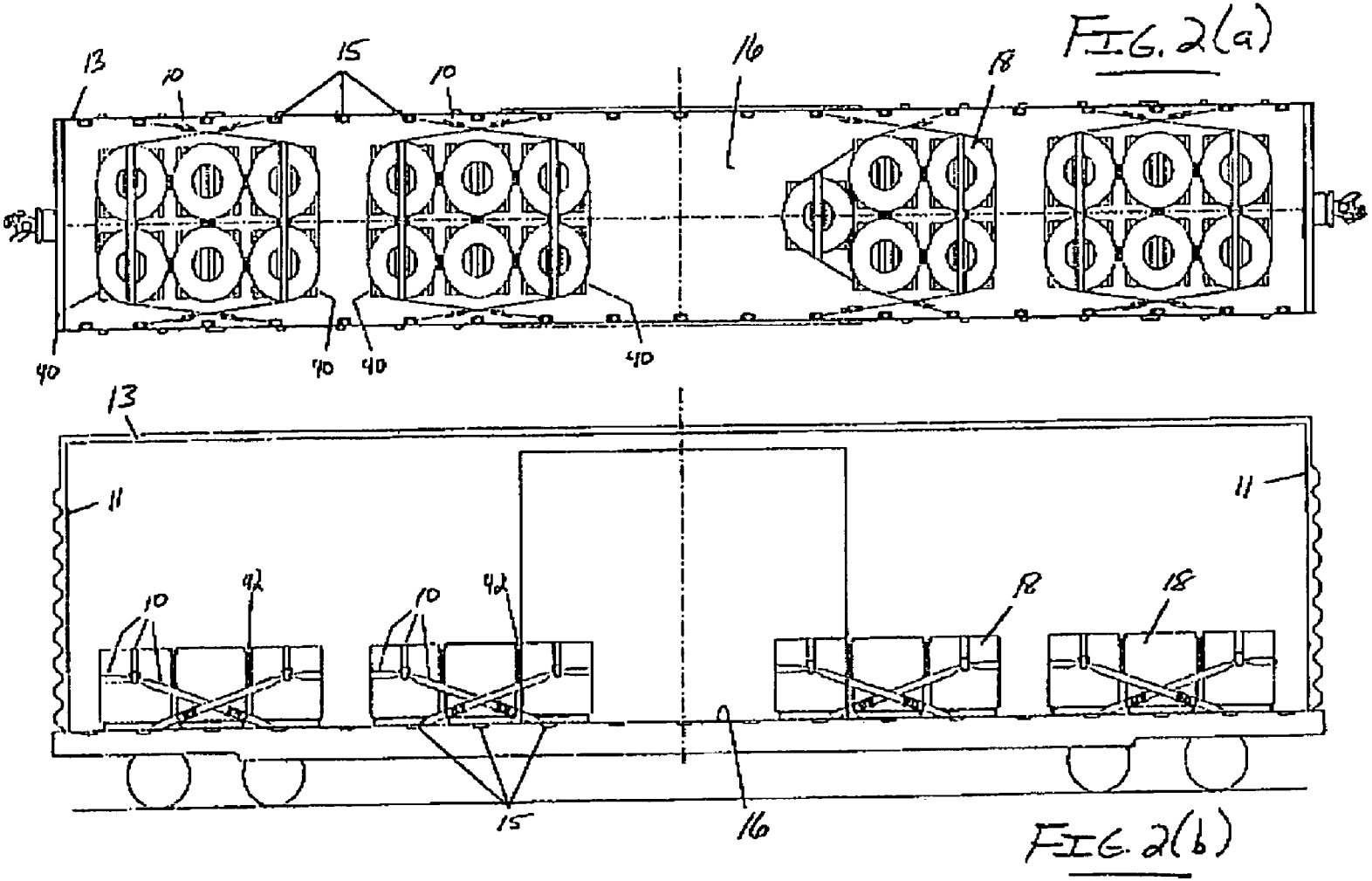
FIG. 2(*a*) is a top plan view of a second railcar showing a second freight arrangement as anchored to the floor of the railcar via the securement system of the invention.
Figure 3:
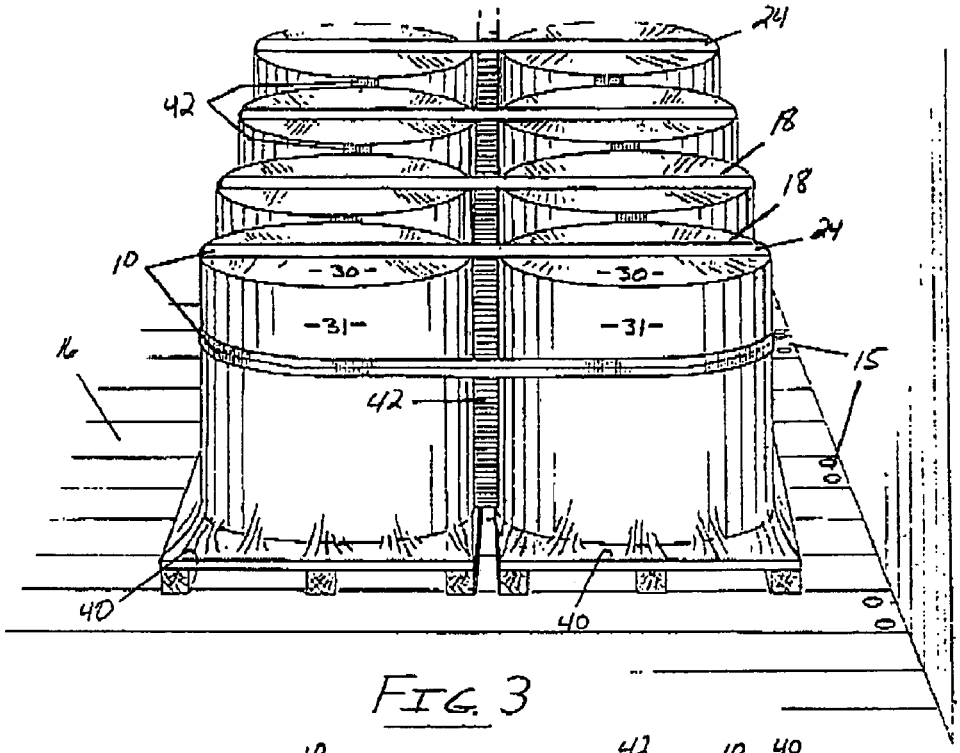
FIG. 3 is a top perspective view of freight secured with the transport space of a railcar by the securement system according to the present invention.
Figure 4:
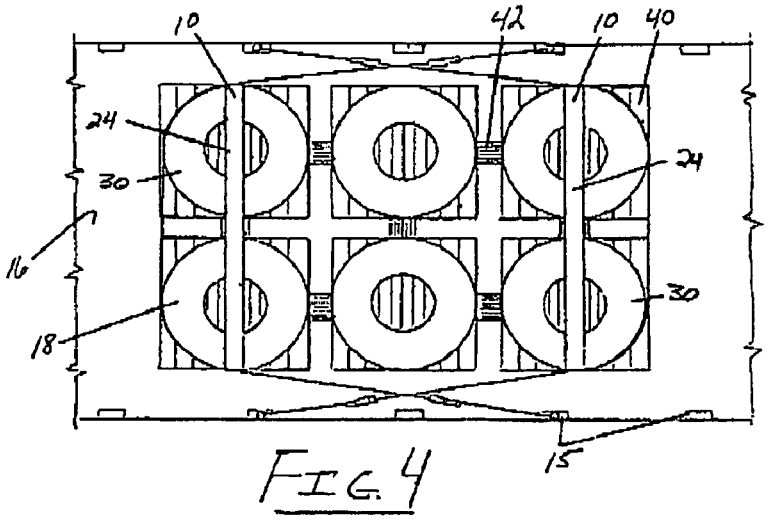
FIG. 4 is a fragmentary top plan view of the inside of a railcar showing an enlarged depiction of the second freight arrangement otherwise depicted in FIG. 2(*a*).

Referring now to the drawings with more specificity, the present invention generally concerns a method, apparatus, and system for restraining or securing freight within a transport space as may be preferably or typically defined by a railcar 13. At its core, the invention stems from a harness apparatus or assembly 10. Used in combination with an array of anchors 15, the harness assembly 10 according to the present invention provides a systemic approach to restraining freight; and certain restraining methodology is developed therefrom.

A railcar 13 or similar other transport vehicle has a plurality of anchors or cleats 15 arrayed in association with a floor 16 or support structure. A first form of anchor 15 may be affixed to the railcar underframe members that provide strength for the car and also support the floor 16. A second form of anchor 15 may be fitted with a base plate and mounted on a bolster near a railcar end. A third form of anchor 15 has 4 holes and is particularly adapted for non-insulated railcars, although for use on open top rail cars as well. A fourth form of anchor 15 is relatively longer than the third form of anchor 15 and uses a rectangular tube and welded flat plate with two holes.

Figure 12:
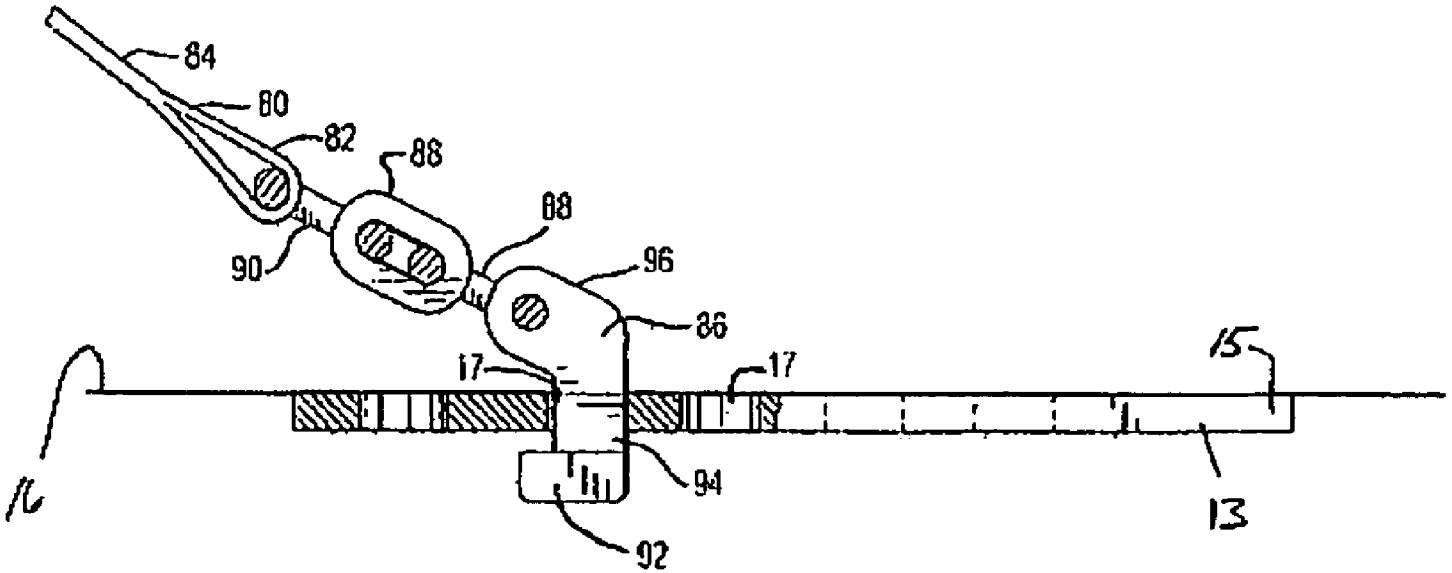
FIG. 12 is a side view depiction of a plate member with anchor end receiving apertures with parts thereof broken away to show the anchored attachment of an anchor end of a strap assembly made part of the harness assembly.
Figure 13:
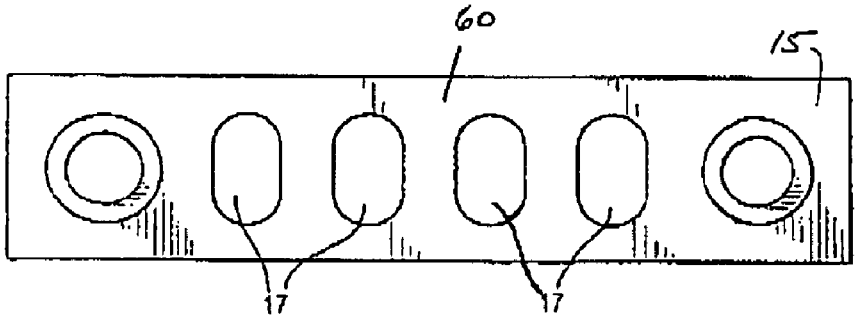
FIG. 13 is a top plan view of a first top plate of an anchor usable in combination with the securement system of the present invention.
Figure 14:
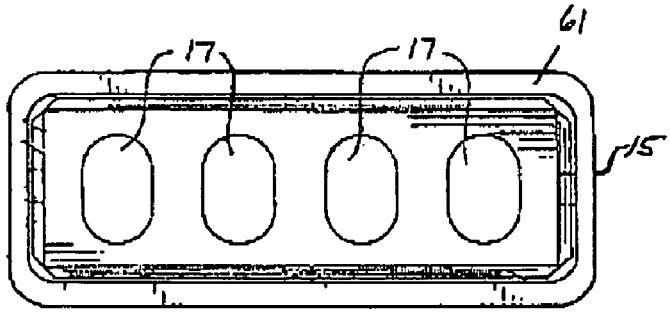
FIG. 14 is a top plan view of a second top plate of an anchor usable in combination with the securement system of the present invention.
Figure 15:
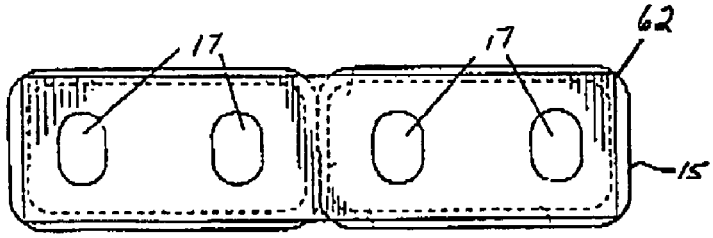
FIG. 15 is a top plan view of a third top plate of an anchor usable in combination with the securement system of the present invention.
Figure 16A:
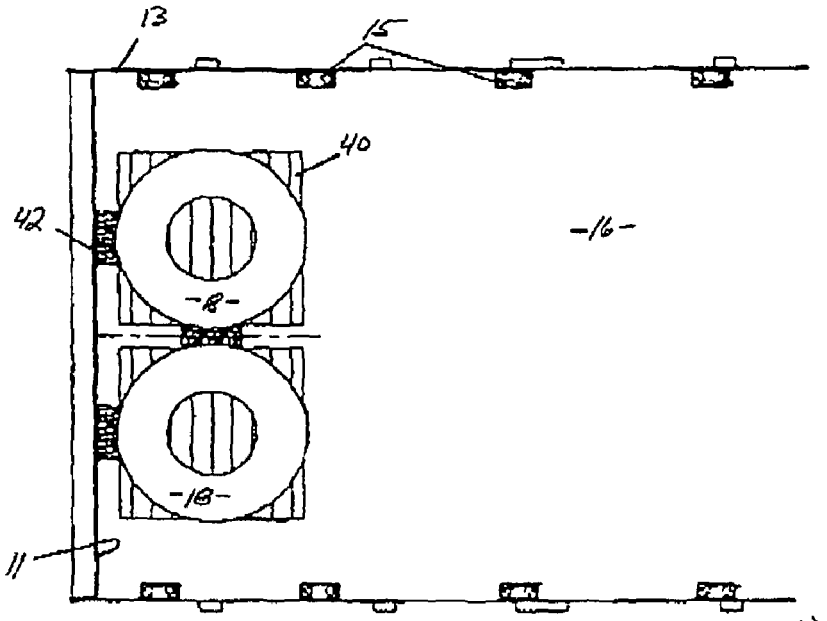
FIG. 16(*a*) is an enlarged fragmentary top plan view of a section of a railcar showing a first freight load positioned within transport space of the railcar, the first freight load being supported by the floor support structure against the end wall of the railcar.
Figure 16B:
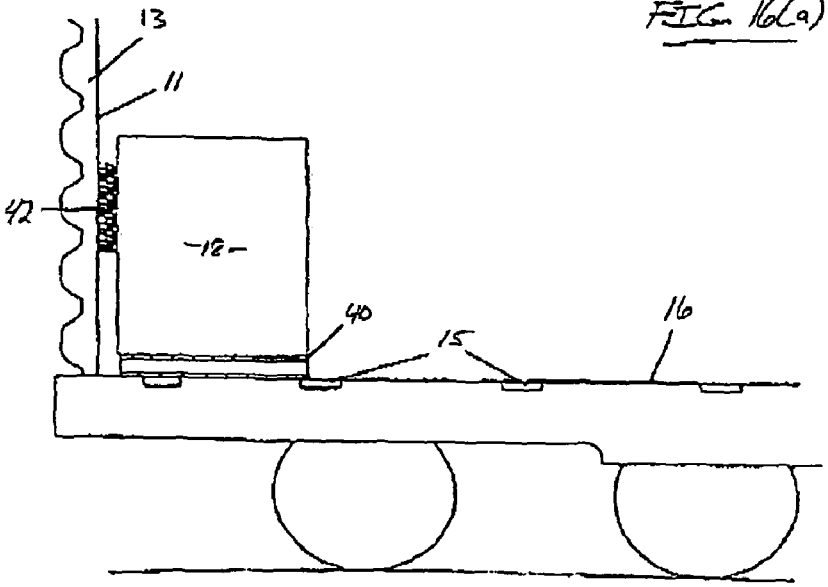
Figure 17A:
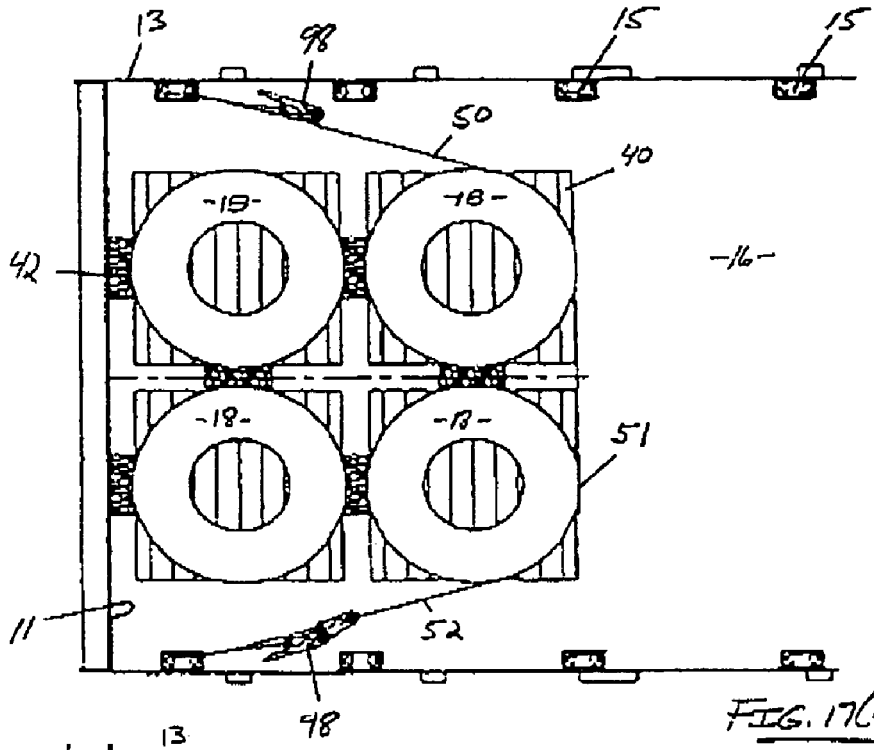
FIG. 17(*a*) is an enlarged fragmentary top plan view of a section of a railcar showing first and second freight loads positioned within transport space of the railcar, the second freight load being supported by the floor support structure against the first freight load, and an optional snugger assembly securing a lower portion of the second freight load.
Figure 17B:
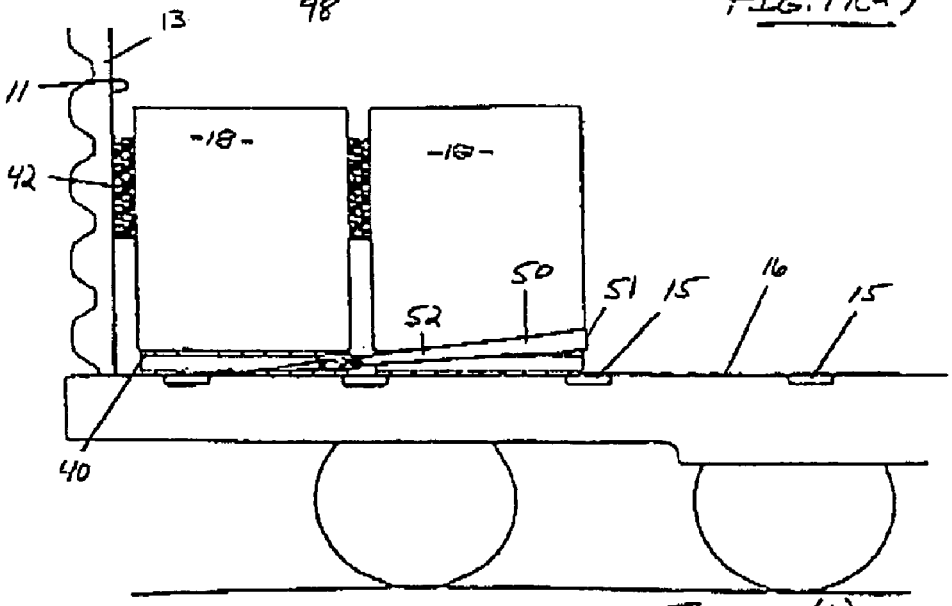
Figure 18A:
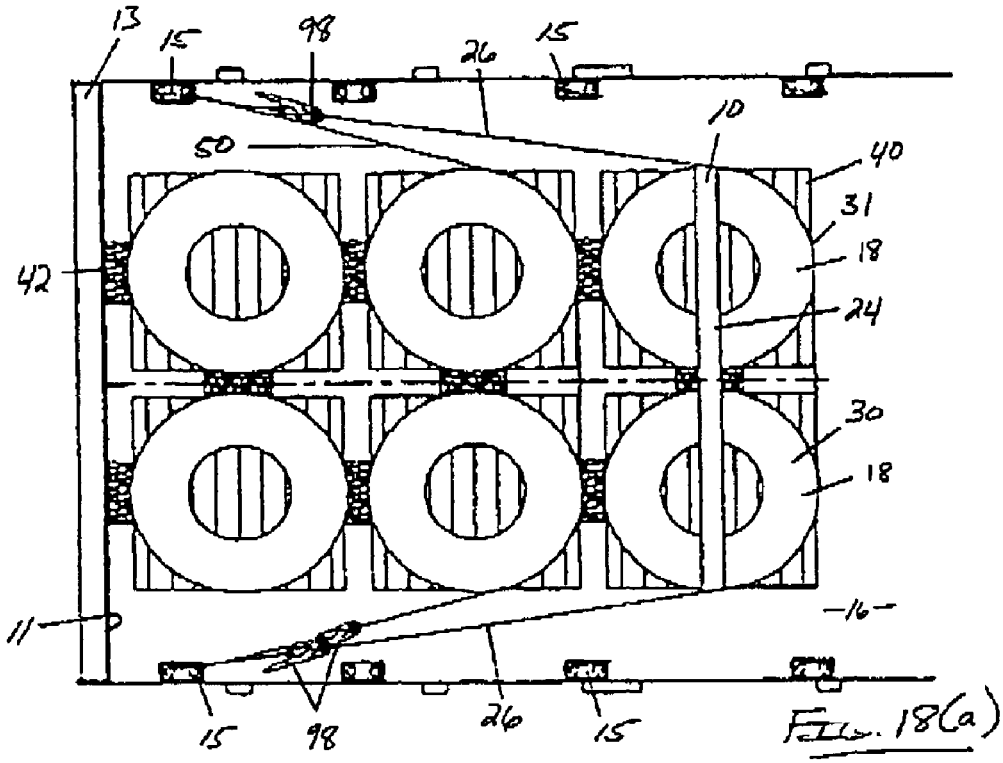
FIG. 18(*a*) is an enlarged fragmentary top plan view of a section of a railcar showing first, second, and third freight loads positioned within transport space of the railcar, the third freight load being supported by the floor support structure against the second freight load, the optional snugger assembly securing a lower portion of the second freight load, and the harness assembly securing an upper portion of the third freight load.
Figure 18B:
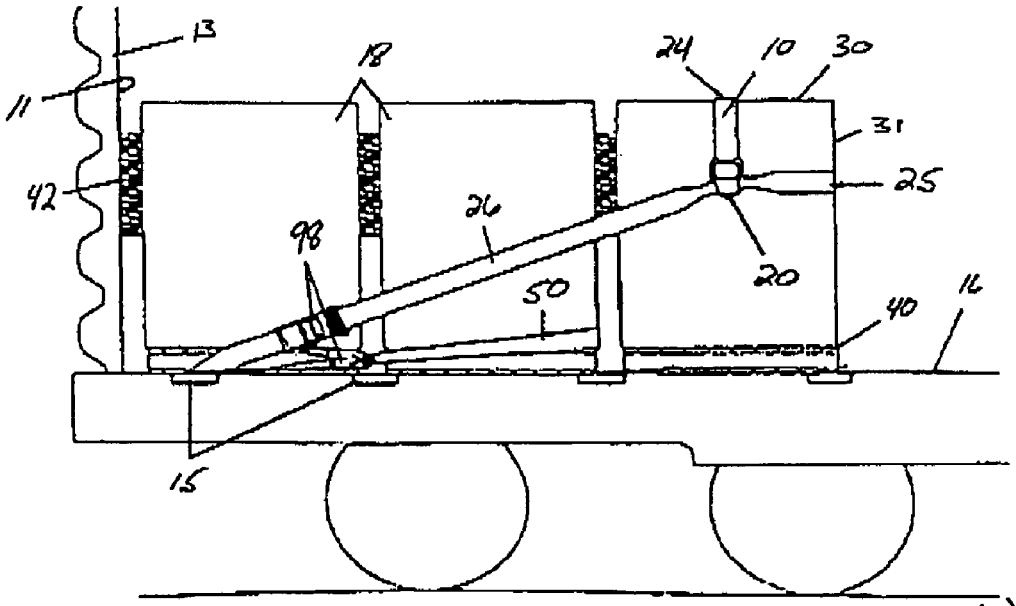
Figure 19A:
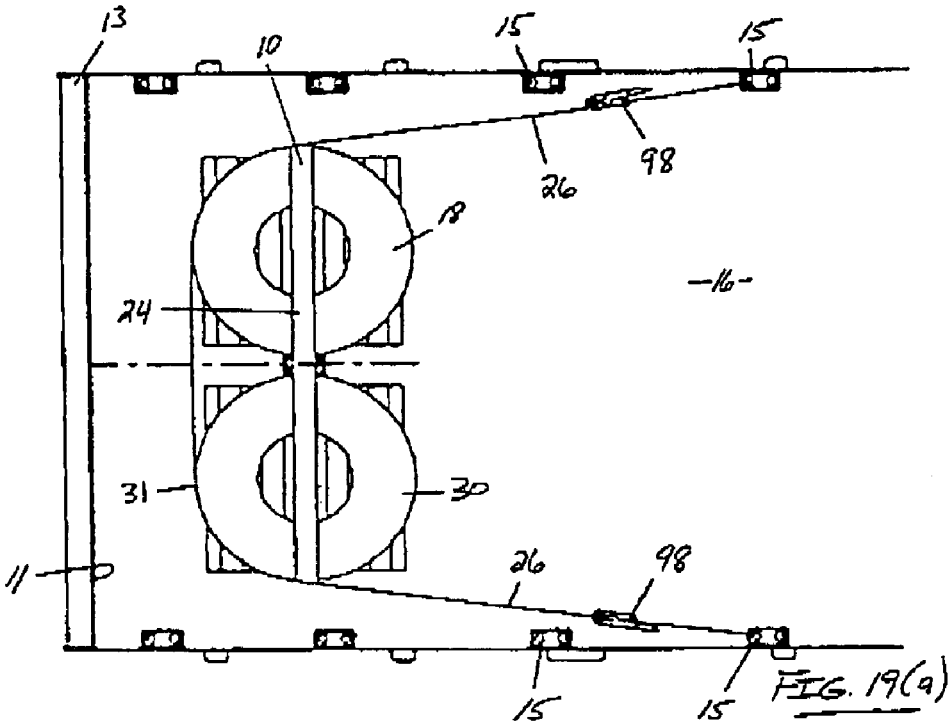
FIG. 19(*a*) is an enlarged fragmentary top plan view of a section of a railcar showing a first freight load positioned within transport space of the railcar, the first freight load being supported by the floor support structure and a first harness assembly.
Figure 19B:
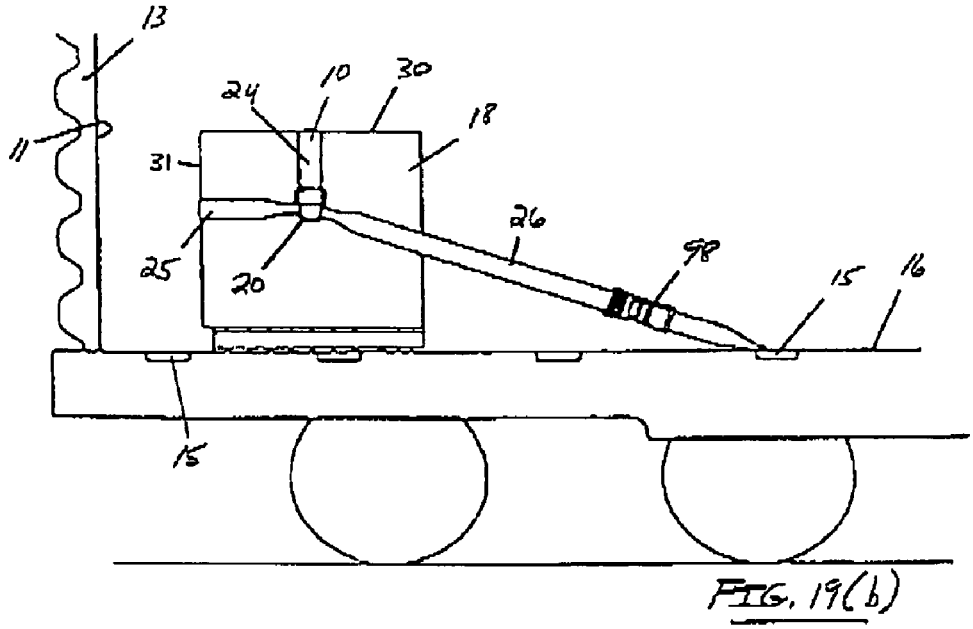
Figure 20A:
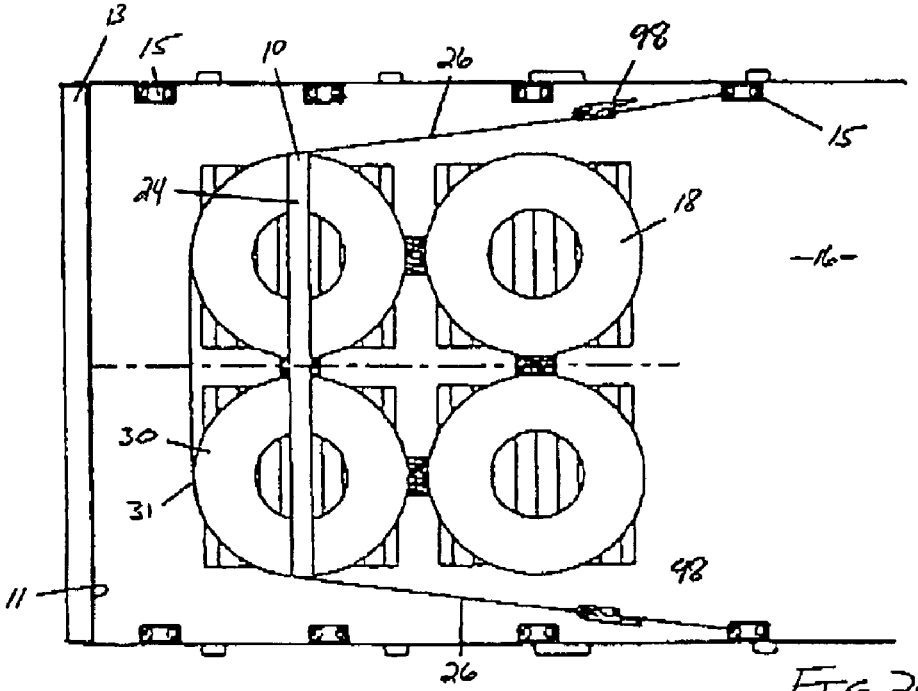
FIG. 20(*a*) is an enlarged fragmentary top plan view of a section of a railcar showing first and second freight loads positioned within transport space of the railcar, the second freight load being supported by the floor support structure against the first freight load.
Figure 20B:
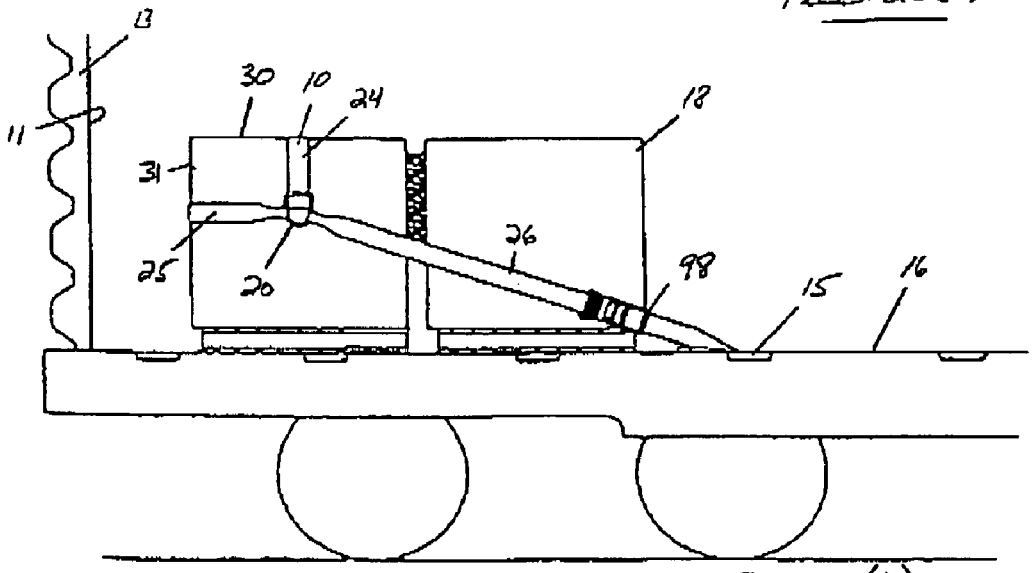
Figure 21A:
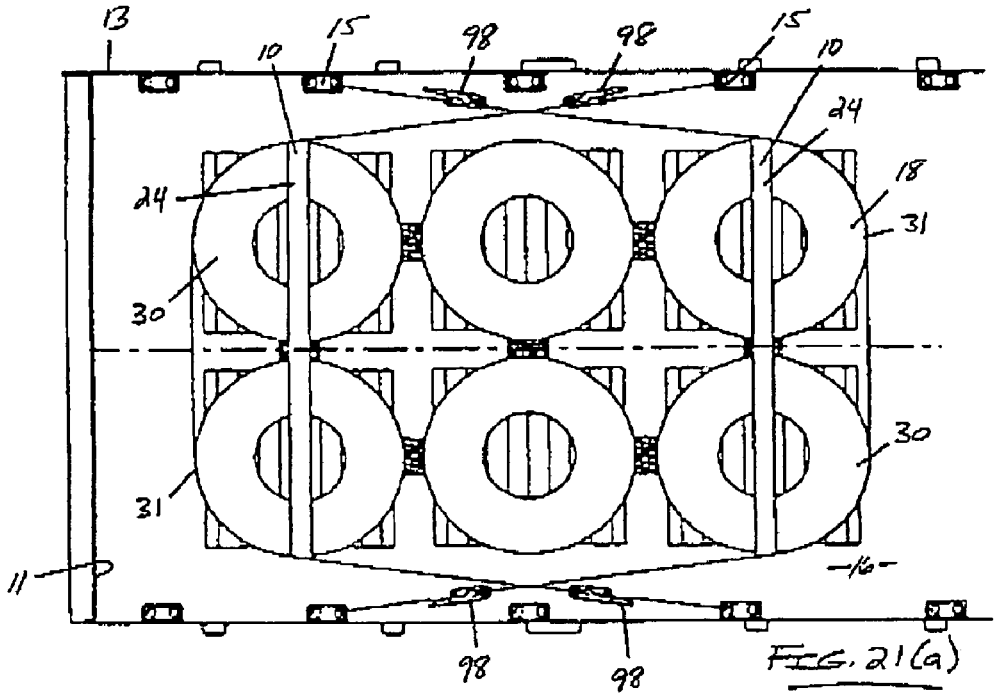
FIG. 21(*a*) is an enlarged fragmentary top plan view of a section of a railcar showing first, second, and third freight loads positioned within transport space of the railcar, the third freight load being supported by the floor support structure against the second freight load, and a second harness assembly securing an upper portion of the third freight load.
Figure 21B:
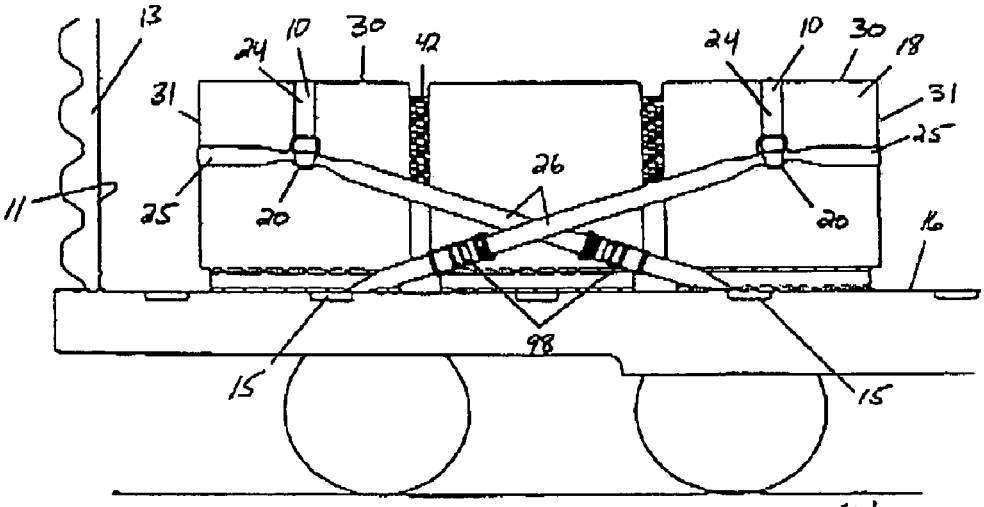

All anchors 15 preferably comprise means for anchoring the anchor ends 29 as may be preferably defined by a plate with end-receiving apertures 17. A side view depiction of a representative plate with end-receiving apertures 17 is generally depicted in FIG. 12. Top plan views of the representative plate as well as certain alternative plates with end-receiving apertures 17 are further depicted in FIGS. 13-15. The first through fourth forms of anchors 15 may be defined by reference to anchors 12, 14, 212, and 214, respectively, in U.S. Pat. No. 6,585,466 ('466 Patent ); U.S. Pat. No. 6,494,651 ('651 Patent ); and U.S. Pat. No. 6,709,209 ('209 Patent ). In other words, the specific structure and function for the various forms of anchors 15 are more fully described in the '466, '651, and '209 Patents, the specification of which are hereby incorporated by reference thereto.

The harness assembly 10 according to the present invention essentially functions to restrain or secure bulky or unwieldy freight, such as coils (as at 18), boxed refrigerators (as at 19), or the like. In this regard, it is noted that freight having a relatively high center of gravity or top heavy freight often succumbs to displacement during transport, and accordingly becomes damaged and/or interferes with the process of loading and unloading cargo, thereby increasing cost and expense to handle the freight.

To more securely restrain freight having a relatively high center of gravity within a transport space (as may be preferably or typically defined by a railcar), the harness assembly 10 preferably comprises first and second opposed D-shaped combination ring buckles, or D-rings 20 having buckle structure 23 otherwise associated therewith for providing opposed junction sites for tensile member termini, and a plurality of tensile members, preferably defined by straps and preferably constructed from 4 inch polyester webbing material with 24,000 lb. breaking strength.

In other words, various tensile members, as may be preferably defined by various straps, each have ends which attach or cooperate with the D-ring buckles or junction rings 20 to form a unique bifurcated harness with tensile tethers extending therefrom. The D-shaped junction rings 20 each preferably comprise a linear portion as at 21 and a curved portion as at 22. The buckle structure 23 enables the user to loop a tensile member, such as a strap, about the liner portion 21 and cinch the same onto itself for adjusting the effective length of the tensile member.

Figure 10:
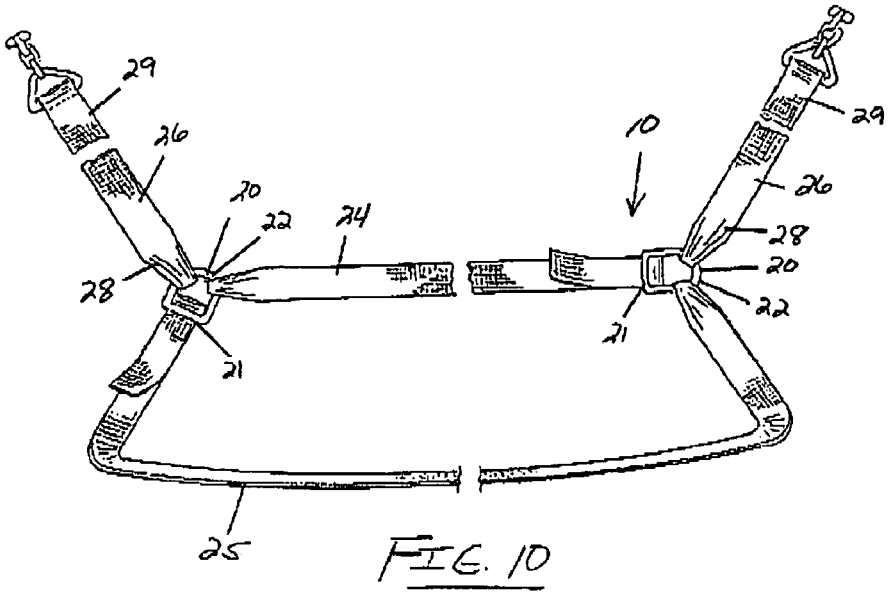
FIG. 10 is a top view of a harness assembly according to the present invention with parts of tensile members or straps broken away.

As indicated, the harness assembly 10 further comprises a series of tensile members or straps. In this regard, four straps are arranged to form a tethered harness-like apparatus as generally depicted in FIG. 10. In other words, the harness assembly 10 preferably comprises four tensile sections including a bifurcated harness preferably comprising a first or top tensile member as at 24 and a second or side tensile member as at 25. As depicted most clearly in FIG. 10, the first tensile member 24 is preferably connected to the linear portion 21 of the first junction ring 20 and the curved portion 22 of the second junction ring 20, while the second tensile member 25 is connected to the linear portion 21 of the second junction ring 20 and the curved portion 22 of the first junction ring 20.

Figure 5:
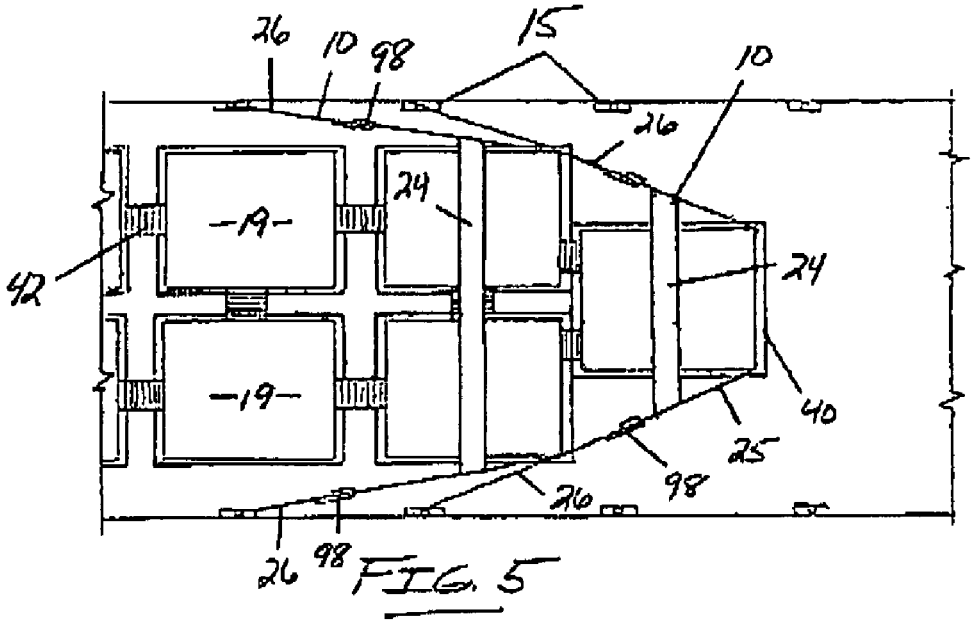
FIG. 5 is a fragmentary top plan view of the inside of a railcar showing an enlarged depiction of a third freight arrangement.
Figure 6:
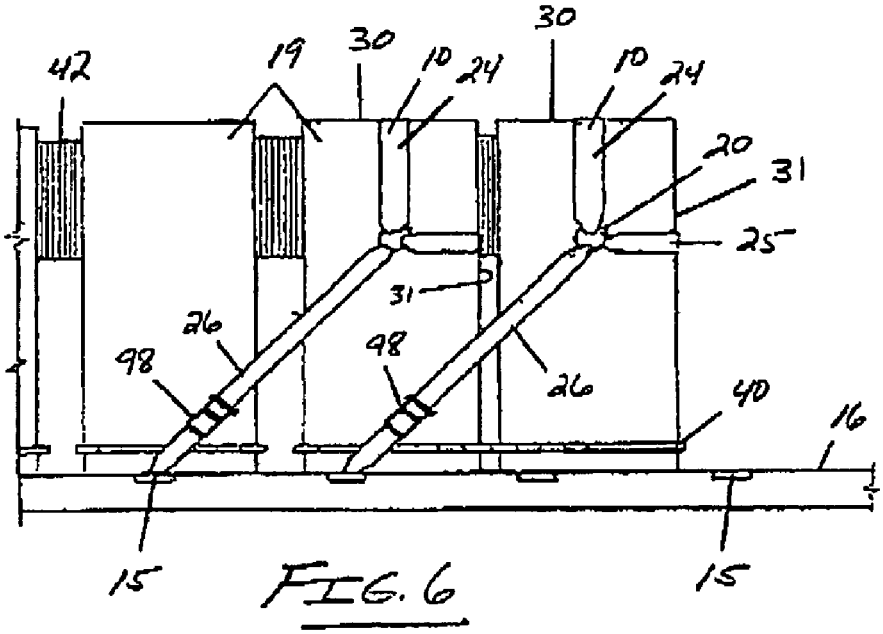
FIG. 6 is a fragmentary side view of the inside of a railcar showing an enlarged depiction of the third freight arrangement otherwise depicted in FIG. 5.
Figure 7:
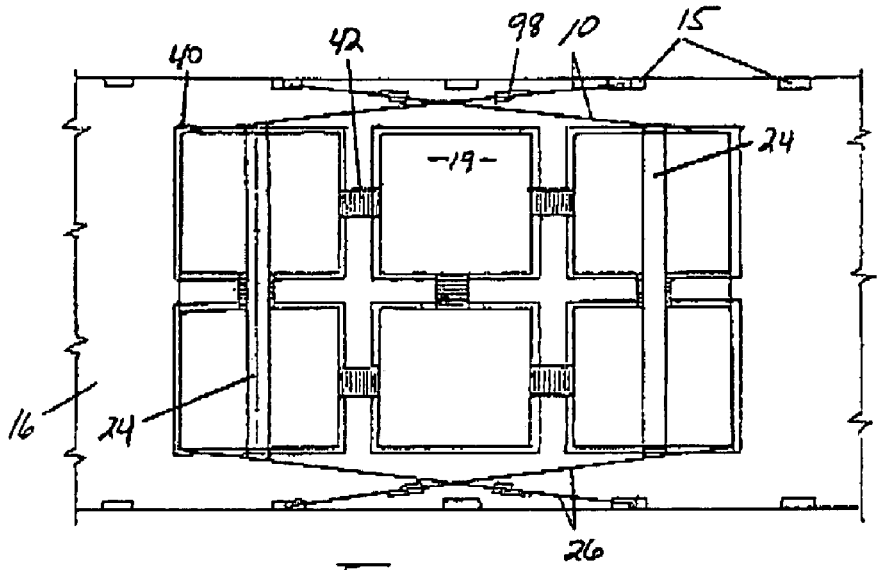
FIG. 7 is a fragmentary top plan view of the inside of a railcar showing an enlarged depiction of a fourth freight arrangement.
Figure 8:
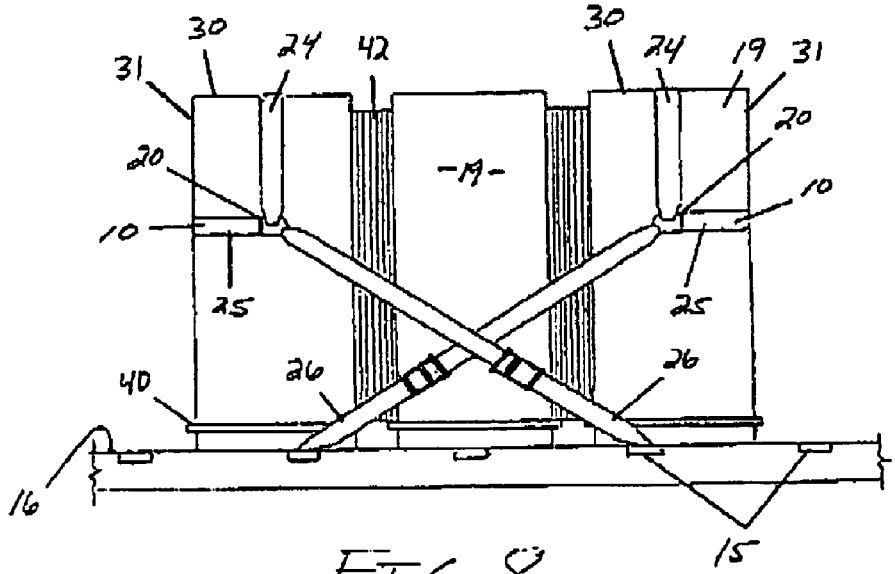
FIG. 8 is a fragmentary side view of the inside of a railcar showing an enlarged depiction of the fourth freight arrangement otherwise depicted in FIG. 7.
Figures 9A, 9B:
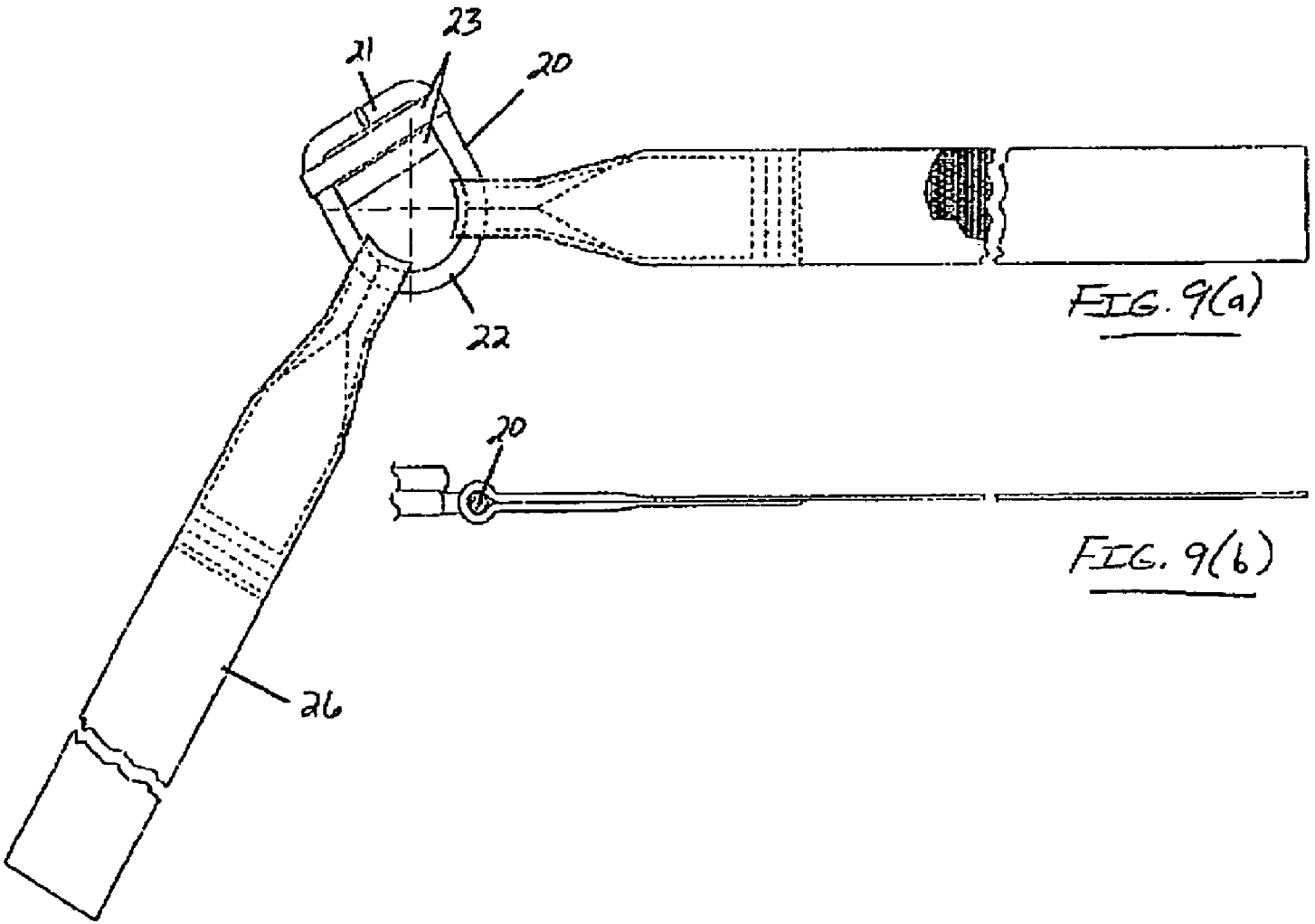
FIG. 9(*a*) is a fragmentary plan type depiction of first and second tensile members joined to a D-ring buckle structure.

By linking the first and second tensile members 24 and 25 in this manner, the buckle structures 23 enable the user to adjust the length of the first and second tensile members 24 and 25 intermediate the junction rings 20. In other words, the buckle structures 23 of the junction rings 20 in cooperative association with members 24 and 25 provide length adjustment means for adjusting the length of the respective tensile members 24 and 25 so as to better engage freight harnessed thereby and thus function to enhance securement of the harness assembly 10 upon freight. A comparison of FIGS. 5 and 7 for example shows two differing freight arrangements. Members 24 are of differing lengths in FIG. 5 and of the same length in FIG. 7.

The third and fourth tensile members (as at 26) of the four tensile members are of substantially identical construction and provide opposed tensile structure. Each of the members 26 preferably comprises a ring end or junction end as at 28 and an anchor end as at 29. The ring or junction ends 28 are preferably connected to the junction rings 20 and the anchor ends 29 extend away from the bifurcated harness toward the anchors 15 as generally depicted in FIG. 10. From a comparative inspection of FIGS. 10-12, it may be seen that the anchor ends 29 are preferably outfitted with hardware to form a loop 82 at the ends of a center web 84. Preferably tensile members 26 may be secured to an anchor 15 with a hook device known in the industry as a "B" hook 86. The best strength and economy is obtained using a pair of links 88 for connection to the "B" hook 86 to interconnect with loop 82 through a "D" ring 90.

Figure 11:
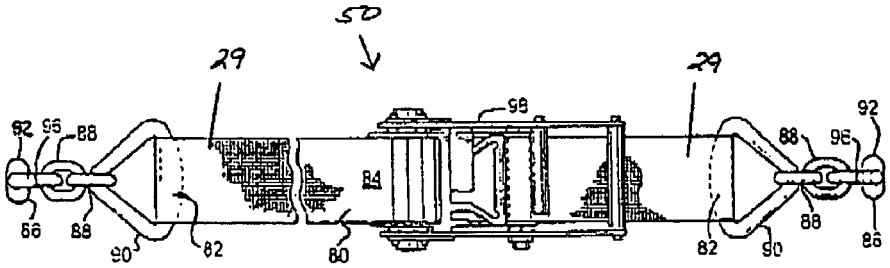
FIG. 11 is a top view of a load securement strap assembly usable in combination with the securement system of the present invention with parts of the tensile member or strap broken away.

"B" hook 86 has locking lobes 92 which fit through apertures 17, with stem 94 projecting through plates 60, 61, or 62 to extend eye portion 96 in the direction of the load. The tensile members 26 and 27 may each be tensioned using a combination adjuster and toggle 98 as generally depicted in FIG. 11. It is contemplated that each anchor 15 are preferably of such construction as to withstand pulling forces through a web strap hook 86 into the cover plate(s) with apertures 17 on the order of at least 48,000 lbs.

The bifurcated harness comprising tensile members 24 and 25 may thus be outfitted upon positioned freight and thereby simultaneously contacts a top end 30 and a side portion 31 (adjacent the top end 30) of the positioned freight. The anchor ends 29 essentially function to anchor the tensile members 26 to the support structure or floor 16. So arranged, the tensile members 26 diagonally direct tension to the bifurcated harness relative to the support structure 16 so as to force the top end 30 toward the support structure 16 and the side portion 31 toward the anchor ends 29 as diagrammatically or generally depicted in FIGS. 22 and 23.

It has been found that certain freight arrangements, such as those generally depicted in FIGS. 1(*a*), 1(*b*), 17(*a*), 17(*b*), 18(*a*), and 18(*b*), it is beneficial to include a snugger assembly 50. In other words, certain harness-outfitted freight may be further and optionally secured with a snugger assembly 50 as generally depicted in Figure No. 11. It is contemplated that the snugger assembly 50 may be described by referring to (FIG. 15 of) the '466 Patent as well as FIG. 11.

Snugger assembly 50 essentially comprises two anchor ends with a webbing material extending therebetween. Each anchor end 29 is preferably outfitted with hardware substantially as earlier described, and a toggle is situated intermediate the webbing length to provide a tensioning mechanism. As outfitted upon freight, the snugger assembly 50 may be said to comprise a far side portion as at 51 and opposed tensile portions as at 52.

The far side portion 51 contacts the far side (akin to side portion 31) (adjacent a bottom end 33) of the freight. The snugger assembly 50 may thus be anchored to the support structure 16 opposite the far side 31 via the tensile portions 52. The tensile portions 52 may be tensioned via the toggle mechanism 98 and thereby force the freight toward the anchor ends 29 or end wall 11. Together, the end wall 11 and tensioned snugger assembly 50 further prevent displacement of the positioned freight and thus essentially function to enhance freight restraint within the transport space.

As shown in the various figures, anchors 15 can be used to secure a variety of loads. Various railcar load securement arrangements may preferably make use of resilient elastomeric pads 40 resting on the support structure 16 or floor and blocking members 42 acting between cargo units and against railcar end walls 44 and/or bulkheads. Preferably, antifriction pads can be a masticated rubber material of a thickness of about ¼". Masticated rubber such as available from Alert Manufacturing specification No. 400 is a combination of rubber and random oriented fiber mixed in sheet form. Blocking members 42 may preferably be resilient foam to help absorb buff and draw forces. These can be of numerous alternatives, including, for example, disposable polystyrene foam pads or corrugated cardboard construction.

Figure 22:
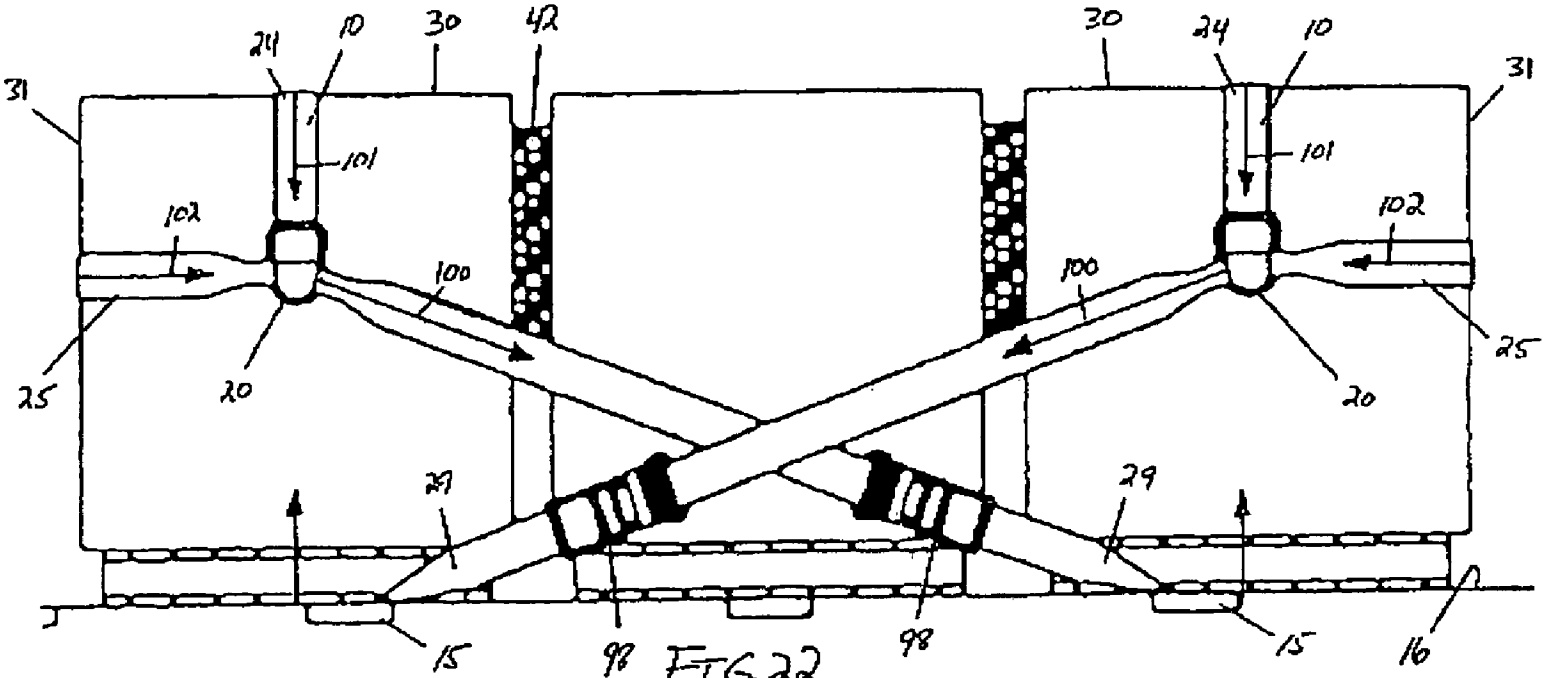
FIG. 22 is an enlarged fragmentary side view depiction of the secured freight loads otherwise depicted in FIG. 21(*b*) diagrammatically showing various basic force vectors.
Figure 23:
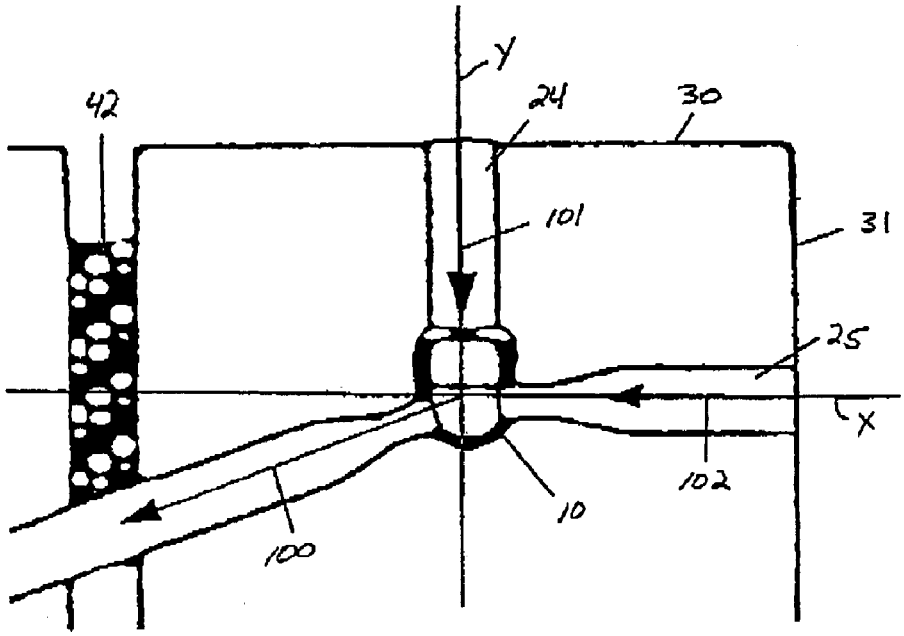
FIG. 23 is an enlarged fragmentary depiction of a generic, secured third freight load with a coordinate axis system placed thereupon to show direction of basic force vectors.
Figure 24:
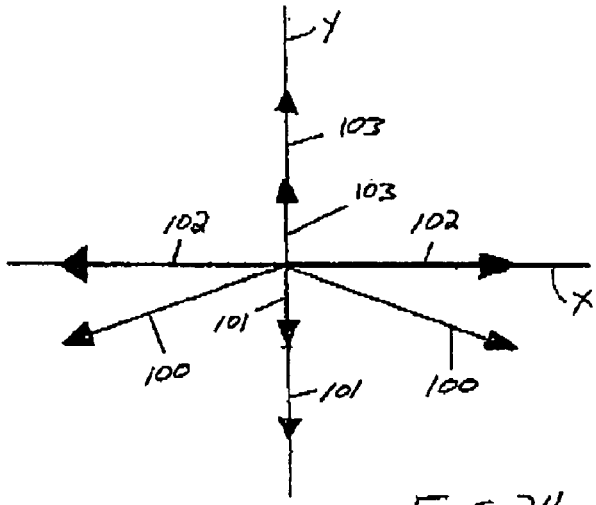
FIG. 24 is an depiction of a coordinate axis system with basic force vectors placed thereupon to demonstrate a net acceleration of zero.

FIGS. 22-24 attempt to depict various basic force loads provided by the harness assembly and certain reaction forces of the surrounding structures, which together function to restrain or secure the positioned freight. In this regard, a diagonally directed tension force 100 is comprises a vertical component force 101 and a horizontal force component 102. The downwardly directed vertical component force 101 operates to force the freight downward toward the support structure 16 via the top end 30. The left or right-directed horizontal component force 102 operates to force the freight either toward the end wall 11 or toward opposed freight depending on the freight arrangement via the side portions 31.

FIG. 24 depicts the force diagram of the double harness assembly arrangement as generally depicted in FIG. 22. Reaction forces 103 at the support structure 16 operate to cancel the downwardly directed force(s) 101 and so that the net acceleration of the freight is zero. In this case, a right-directed horizontal component force 102 is negated by a left-directed horizontal component force 102, and thus there is a net horizontal acceleration of zero. It should be understood that when freight is packed against end wall 11, that a reaction force equal in magnitude and opposite in direction to the horizontal component force 102 will operate to provide a net acceleration of zero. Notably, the vertical component force(s) 101 have been shown as doubled as have the reaction forces 103 to depict the two harness scenario.

While the present inventive subject matter has been disclosed and described with reference to particular embodiments and methods, it should be readily apparent that variations and modifications may be made therein. It is also noted that the present invention is independent of the particular transport medium such as a railcar, although a transport space is required, which space provides necessary reaction forces to enable zero net acceleration of the positioned freight. It is, thus, intended in the following claims to cover each variation and modification that falls within the true spirit and scope of the present invention.

For example, it is contemplated that the current invention supports certain freight restraining methodology. In this regard, the present invention may be said to disclose a method for restraining freight in a railcar comprising the steps of: positioning a first set of freight units at an end of a railcar, which first set of freight units is thereby supported by a support structure and make contact with a railcar wall. After positioning the first set of freight units, a second set of freight units may be positioned adjacent or against the first set of freight units. The second set of freight units is thereby supported by the support structure and contact the first set of freight units.

A third set of freight units may then be position adjacent the second set of freight units, which third set is thereby supported by the support structure and makes contact with the second set of freight units. After all freight units are properly positioned (in this example, plural-pieced having three sets), the freight may be outfitted with the bifurcated harness by crossing a top end and a far side of the third set of freight units. Notably, the far side of the third set of freight units is opposite the second set of freight units.

The bifurcated harness may then be anchored to the support structure adjacent the first set of freight units via opposed tension members connected to the bifurcated harness. The tension members may thereafter be diagonally tension relative to the support structure thereby simultaneously forcing the third set of freight units toward the support structure via the top portion of the bifurcated harness and forcing the third set of freight units against the second set of freight units via a side portion of the bifurcated harness. This action functions to pack the freight units against the end wall as at 11.

The foregoing methodology is supported by the harness assembly according to the present invention, which assembly essentially functions to restrain freight within a transport space. The harness assembly may be said to essentially comprise first and second junction rings, a bifurcated harness, and opposed third-type tensile members. The junction rings provide opposed junction sites for tensile member termini. The bifurcated harness comprises first and second tensile members, each of which have opposed member termini connected to the junction rings. The third-type tensile members, the third-type tensile members each have a ring end and an anchor end. The ring ends are connected to the junction rings, and the anchor ends extend away from the bifurcated harness.

The bifurcated harness, having a top-contacting member and a side-contacting member, contacts a top end and a side portion of positioned freight. The anchor ends of the third-type tensile members together anchor the third-type tensile members to a support structure such as a railcar floor. The third-type tensile members thereby diagonally direct tension to the bifurcated harness relative to the support structure so as to force the top end of the freight toward the support structure and the side portion of the freight toward the anchor ends of the harness assembly.

Viewed systemically, the present invention may be said to disclose a freight restraint system for restraining freight within a transport space, which freight restraint system may be said to comprise a plurality of load-restraining anchors (as may be preferably defined by at least two anchors of U.S. Pat. No. 6,494,651 ('651 Patent ); U.S. Pat. No. 6,585,466 ('466 Patent ); and U.S. Pat. No. 6,709,209 ('209 Patent ) in combination with the harness assembly of the present invention.

The load-restraining anchors may thus be arrayed in association with a support structure, which support structure defines a lower boundary of the transport space. Each load-restraining anchor essentially comprises a top plate mountable adjacent the support structure, which plate comprises at least one, but preferably a plurality of anchor end receivable apertures. Each anchor is adapted to be fitted to the support structure and set so the top plate is flush with the support structure.

Each harness assembly may be said to alternatively comprise opposed junction structures and four tensile members. The junction structures provide opposed junction sites for coupling tension member termini thereto. First and second of the four tensile members each comprises opposed member termini for joining each of the first and second tensile members to both junction structures. The third and fourth of the four tensile members each comprises a junction end and an anchor end. The junction ends join the third and fourth tensile members to the junction structures. The anchor ends anchoring the third and fourth tensile members to a select pair of opposed anchors.

The first and second tensile members respectively contact a top end and a side portion of freight, while the third and fourth tensile members diagonally direct tension into the junction structures relative to the support structure. The junction structures transmit the diagonally directed tension into the first and second tensile members for forcing the top end of the freight toward the support structure and the side portion of the freight toward the anchor ends. The system thus restrains the positioned freight.

From the foregoing, it will be observed that numerous variations and modifications of the underlying inventive subject matter may be effected without departing from the spirit and scope of the invention. Further, certain freight restraining methodology is supported by the basic understanding of the inventive harness assembly. Thus, it is to be understood that no limitation with respect to the specific apparatus and/or methodology illustrated herein is intended or should be inferred. It is, of course, intended to cover by the appended claims all such modifications as fall within the scope of the claims.

I claim:

1. A method for restraining freight within a transport space, the method comprising the steps of:

positioning first freight within a transport space bound by a support structure, the first freight being supported by the support structure;

outfitting the first freight with a first harness assembly, the first harness assembly comprising a bifurcated harness and opposed tensile members connected to the bifurcated harness, the bifurcated harness contacting a first top end and a first side of the first freight;

anchoring the first harness assembly to the support structure opposite the first side via the tensile members of the first harness assembly;

positioning second freight within the transport space, the second freight being supported by the support structure in contact with the first freight;

outfitting the second freight with a second harness assembly identical to the first harness assembly, the bifurcated harness of the second harness assembly contacting a second top end and a far side of the second freight;

anchoring the second harness assembly to the support structure opposite the far side via the tensile members of the second harness assembly; and diagonally tensioning the tension members of the first and second harness assemblies relative to the support structure thereby forcing the first and second top ends toward the support structure and the first and far sides toward one another, the support structure, the first and second freight, and the tensioned first and second harness assemblies preventing displacement of the positioned first and second freight and thus restraining same within the transport space.

2. The method of claim 1 wherein third freight is situated intermediate the first and far sides, the first and second harness assemblies pacing the first, second, and third freight when the tensile members are diagonally tensioned.

3. The method of claim 1 wherein force-absorbing means are situated intermediate the first and second freight before said step of diagonally tensioning the tension members of the first and second harness assemblies relative to the support structure.

4. The method of claim 2 wherein force-absorbing means are situated intermediate the first and third and second freight before said step of diagonally tensioning the tension members of the first and second harness assemblies relative to the support structure.

5. The method of claim 1 wherein padding means are situated intermediate the first and second freight and the support structure before respectively supporting the first and second freight via the support structure.

6. The method of claim 2 wherein padding means are situated intermediate the first, third, and second freight and the support structure before respectively supporting the first, third, and second freight via the support structure.

* * * * *